United States Patent [19]

Ranno, Sr.

[11] Patent Number: 4,554,869

[45] Date of Patent: Nov. 26, 1985

[54] AUXILIARY FORM ROLLER APPARATUS FOR ROTARY OFFSET LITHOGRAPHIC DUPLICATING MACHINES

[76] Inventor: Edward N. Ranno, Sr., 245 Ellen Dr., Park Ridge, N.J. 07656

[21] Appl. No.: 585,113

[22] Filed: Mar. 1, 1984

[51] Int. Cl.[4] ..... B41L 17/00

[52] U.S. Cl. ..... 101/145; 101/349; 101/352

[58] Field of Search ..... 101/148, 349, 350, 351, 101/352, 145

[56] References Cited

U.S. PATENT DOCUMENTS

| | | | |
|---|---|---|---|
| 68,471 | 9/1867 | Verney | 101/350 |
| 771,900 | 10/1904 | Finch | 101/349 |
| 982,579 | 1/1911 | Doremas | 101/349 |
| 1,711,148 | 4/1929 | Hult | 101/349 |
| 2,109,768 | 3/1938 | Crabtree | 101/351 |
| 2,584,380 | 2/1952 | Delaplane | 101/148 |
| 2,802,417 | 8/1957 | Forbes | 101/350 |
| 2,892,399 | 6/1959 | Chase | 101/349 |
| 2,929,316 | 3/1960 | Fowlie | 101/148 |
| 3,039,386 | 6/1962 | Trisler | 101/352 |
| 3,343,484 | 9/1967 | Dahlgren | 101/350 |
| 3,691,956 | 9/1972 | James | 101/352 |
| 3,911,815 | 10/1975 | Banfer | 101/350 |
| 4,429,631 | 2/1984 | Commers | 101/349 |

FOREIGN PATENT DOCUMENTS

| | | | |
|---|---|---|---|
| 413078 | 5/1925 | Fed. Rep. of Germany | 101/351 |
| 1418869 | 12/1975 | United Kingdom | 101/349 |
| 1601603 | 11/1981 | United Kingdom | 101/349 |

*Primary Examiner*—Clyde I. Coughenour

*Attorney, Agent, or Firm*—W. Patrick Quast

[57] ABSTRACT

Auxiliary form roller apparatus is provided for rotary offset lithographic duplicating machines to increase the number of form rollers and more uniformly distribute the ink over the master cylinder. The apparatus has a frame formed by a pair of oppositely-disposed, substantially J-shaped support arms which are separated and joined by laterally extending support members. One end of each support arm is bifurcated to receive the main frame support rod of the duplicating machine and the other end of the arm is slotted to slidably receive and support one of the end bearings of a rotatable, auxiliary form roller which is disposed between the arms and is adapted to bear against the master cylinder at a location which is spaced a peripheral distance from the existing form rollers of the machine. A laterally-oscillating, rotatable auxiliary oscillator roller is swingably mounted on the support arms and is so disposed as to engage the auxiliary form roller and one of the existing form rollers of the machine to provide for uniform ink transfer from the existing form roller to the auxiliary form roller. The frame arms are apertured between the ends thereof to receive a laterally-extending, eccentric adjusting rod which also passes through and is supported by a pair of mounting blocks which are adapted to be secured to the main frame members of the duplicator to support the apparatus. Rotatable eccentric bearings are provided for the adjusting rod so that the axis of the auxiliary form roller may be suitably adjusted with respect to the axis of the master cylinder to provide a uniform line contact between the auxiliary form roller and the master cylinder.

13 Claims, 14 Drawing Figures

AUXILIARY FORM ROLLER APPARATUS FOR ROTARY OFFSET LITHOGRAPHIC DUPLICATING MACHINES

BACKGROUND OF THE INVENTION

1. Field of the Invention

This invention relates to rotary offset lithographic duplicating machines and more particularly to auxiliary form roller apparatus therefor which may be easily installed on virtually all of the commercially-available types of such machines to provide more uniform ink distribution on the master cylinder of the machines.

2. Description of the Prior Art

In the rotary offset lithographic duplicating process, a rotating master cylinder is provided with a detachable master sheet or "master" upon which the image to be reproduced is fixed. The image area is treated with an ink-attractive substance which will accept ink but repel a moisturizing or dampening liquid. The master cylinder is supplied with ink by one or more machine form rollers which are coupled to an ink fountain by means of an ink transfer roller train so that the image on the master is coated with ink from the fountain. A moisture roller is arranged to engage the master cylinder so that the non-image areas of the master are coated with moisture or dampening agent. The dampening agent prevents the ink from the form rollers from adhering to the clear, non-image bearing area of the master. As the master cylinder rotates, it engages a rotatable blanket cylinder which receives the ink from the image area of the master and transfers it to paper which is fed between the blanket cylinder and an impression cylinder which engages the blanket cylinder. In this manner, the image is transferred to the paper.

A principal problem associated with this type of reproduction process is that the ink from the machine form rollers is not always uniformly distributed over the image areas of the master. When this happens, some of the image areas may be lighter in tone or color than the other image areas or a fairly large image area intended to have a solid, uniform color may have a washed-out or non-uniform appearance. One solution to this problem is, of course, to provide the master cylinder with more machine form rollers so that the ink from the ink fountain is distributed more uniformly over the surface of the master cylinder and is milled into finer films for clean half-tones and bold solids. Although some newer models of offset duplicating machines have been provided with an additional form roller for this purpose, the vast majority of older duplicating machines in use at the present time have only two form rollers.

At first glance, it would appear to be a simple problem to merely add an additional form roller to an older duplicating machine to improve ink distribution. However, the common design features of the many different types of older duplicating machines make it extremely difficult to install an additional or auxiliary form roller to the machines after the machines have been built. The average owner of such older types of duplicating machines does not have the time or the technical expertise to modify his existing duplicating machines to add an additional or auxiliary form roller. Furthermore, the basic designs of the older duplicating machines are so many and varied as to heretofore prevent the development of suitable auxiliary form roller apparatus which may be readily installed in virtually all of the older types of machines by persons having only average mechanical skills.

SUMMARY OF THE INVENTION

It is an object of this invention to provide auxiliary form roller apparatus for rotary offset lithographic duplicating machines and the like which provides more uniform ink distribution on the master cylinder of such machines.

It is a further object of this invention to provide auxiliary form roller apparatus for rotary offset lithographic duplicating machines which will fit virtually all of the many different types of such duplicating machines in use at the present time.

It is a still further object of this invention to provide auxiliary form roller apparatus for rotary offset lithographic duplicating machines which may be easily and quickly installed on such machines without requiring substantial machine modification or alteration.

It is an additional object of this invention to provide auxiliary form roller apparatus for rotary offset lithographic duplicating machines which is easy to clean, service and maintain.

It is another object of this invention to provide auxiliary form roller apparatus for rotary offset lithographic duplicating machines which is mechanically rugged and substantially trouble-free in operation.

Briefly, the auxiliary form roller apparatus of the invention may be attached to rotary offset lithographic duplicating machines of the type having a bed, a pair of spaced-apart main frame members extending upwardly and outwardly from the bed, a main frame support rod extending laterally between the frame members adjacent the tops thereof, a master cylinder and at least one machine form roller contacting the master cylinder at a first point on the periphery thereof. The apparatus of the invention comprises an auxiliary form roller; an auxiliary oscillator roller which is oscillatable laterally along its axis of rotation in response to rotation thereof; an auxiliary frame having guide means at one end thereof adapted to pivotally engage the main frame support rod for support thereby, first mounting means at the other end thereof for rotatably mounting the auxiliary form roller thereon, and second mounting means disposed between the ends thereof for rotatably mounting the auxiliary oscillator roller thereon with the auxiliary oscillator roller in rolling contact with the auxiliary form roller; and third mounting means disposed between the ends of the auxiliary frame for mounting the auxiliary frame on the main frame members of the machine with the guide means engaging the main frame support rod, the auxiliary form roller contacting the master cylinder at a second point on the periphery thereof which is spaced a peripheral distance from the first point, and the auxiliary oscillator roller engaging the machine form roller so that ink from the machine form roller is transferred to the master cylinder via the auxiliary oscillator roller and the auxiliary form roller. Control means disposed between the auxiliary frame and the third mounting means are provided to cause relative movement therebetween, so that the auxiliary frame is adapted to pivot about the longitudinal axis of the main frame support rod to cause the auxiliary form roller to engage and disengage the master cylinder.

The auxiliary frame may comprise a pair of arcuately-shaped, spaced-apart support arms having an arcuate length substantially corresponding to the arcuate distance between the main frame support rod and the second point on the master cylinder periphery, and support means extending laterally between the support arms for support thereof. The first mounting means may comprise an auxiliary form roller support shaft and a pair of bearing members mounted on the ends of the form roller shaft. Each bearing member has a rectangular boss portion which is slidably disposed in a slotted opening in the support arms. The second mounting means has a pair of spaced-apart mounting arms each having one end thereof pivotally mounted on a different one of the support arms and the other end thereof rotatable about the mounting pivot point in a plane which is substantially perpendicular to the axis of rotation of the oscillator roller, an auxiliary oscillator roller support shaft having transverse bores therein adjacent the ends thereof to slidably receive the other ends of the mounting arms, spring biasing means and retaining means to hold the support shaft in place on the mounting arms.

The nature of the invention and other objects and additional advantages thereof will be more readily understood by those skilled in the art after consideration of the following detailed description taken in conjunction with the accompanying drawings.

DESCRIPTION OF THE PREFERRED EMBODIMENT OF THE INVENTION

Figure 1:
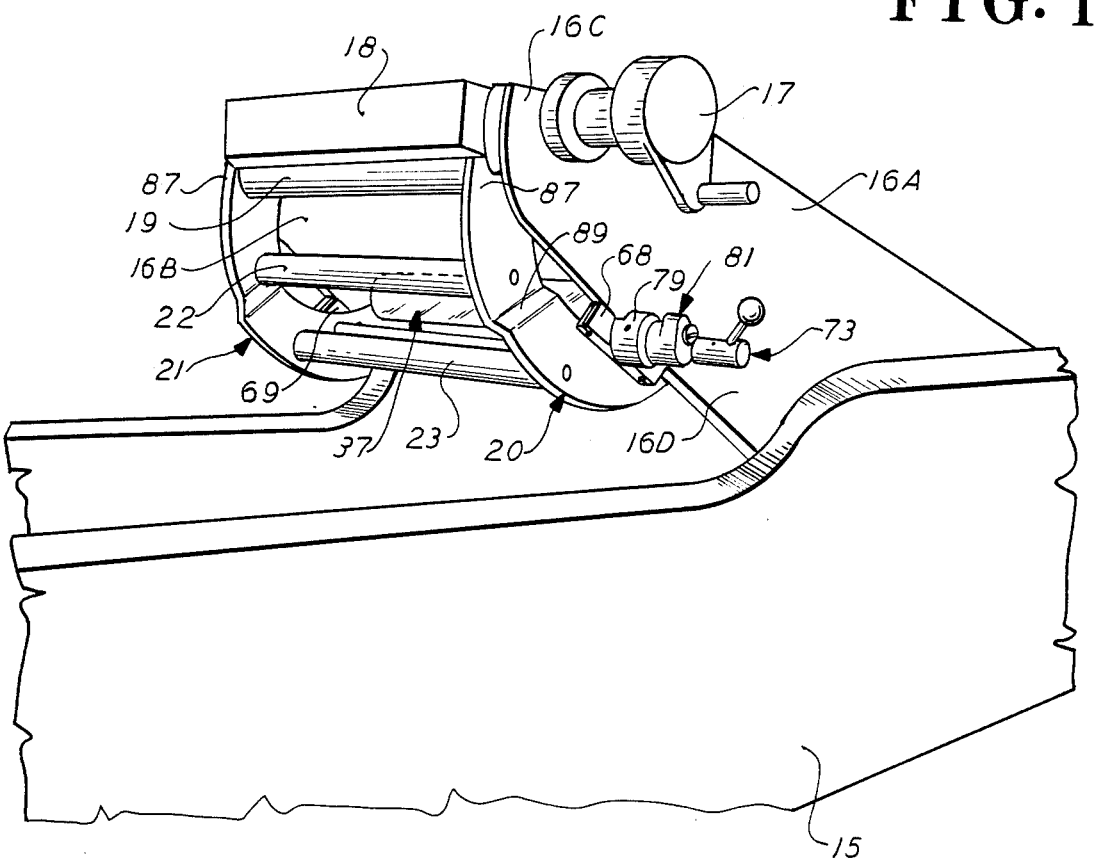
FIG. 1 is a perspective view of a portion of a rotary offset lithographic duplicating machine showing the auxiliary form roller apparatus of the invention installed.

Referring now to FIG. 1 of the drawings, the auxiliary form roller apparatus of the invention is shown mounted on a rotary offset lithographic duplicating machine having a bed 15, a pair of spaced-apart main frame members 16A and 16B extending upwardly and outwardly from the bed and an operating control 17. For convenience of illustration, the well-known parts of the duplicating machine, such as the copy tray, the moisturizer or dampening agent supply and the various other operating controls, for example, have been omitted since the construction and operation of machines of this type are well documented in the prior art. The side of the machine having main frame member 16A thereon is customarily referred to as the "operator's side" and the side of the machine having main frame member 16B thereon is referred to as the "gear side". The machine illustrated is provided with an ink tray or "fountain" 18 which extends laterally between the main frame members 16A and 16B. Below the fountain 18 and adjacent the tops 16C of the frame members is a main frame support rod 19 which extends laterally between the frame members 16 to provide structural support. A support rod of this type is found in approximately the same location in virtually all of the rotary offset lithographic duplicating machines in current use at the present time and is used as a support point for the auxiliary form roller apparatus of the invention as hereinafter explained. The master cylinder of the machine is not visible in the view of FIG. 1 but extends laterally between the main frame members 16A and 16B adjacent the bottom portions 16D thereof.

Figure 2:
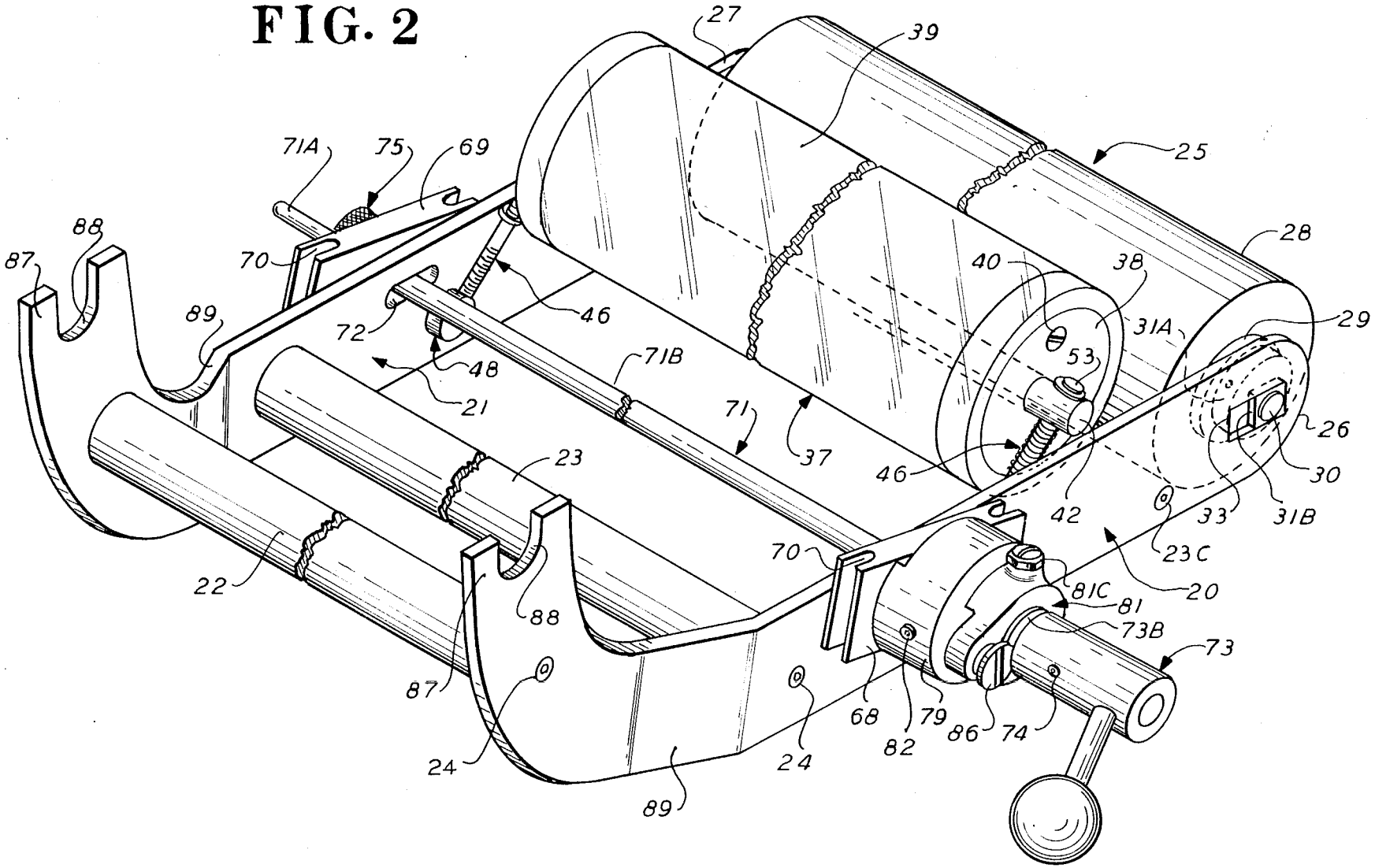
FIG. 2 is a top perspective view of the auxiliary form roller apparatus of the invention with the laterally-extending shafts, support members and rollers foreshortened for convenience of illustration.
Figure 3:
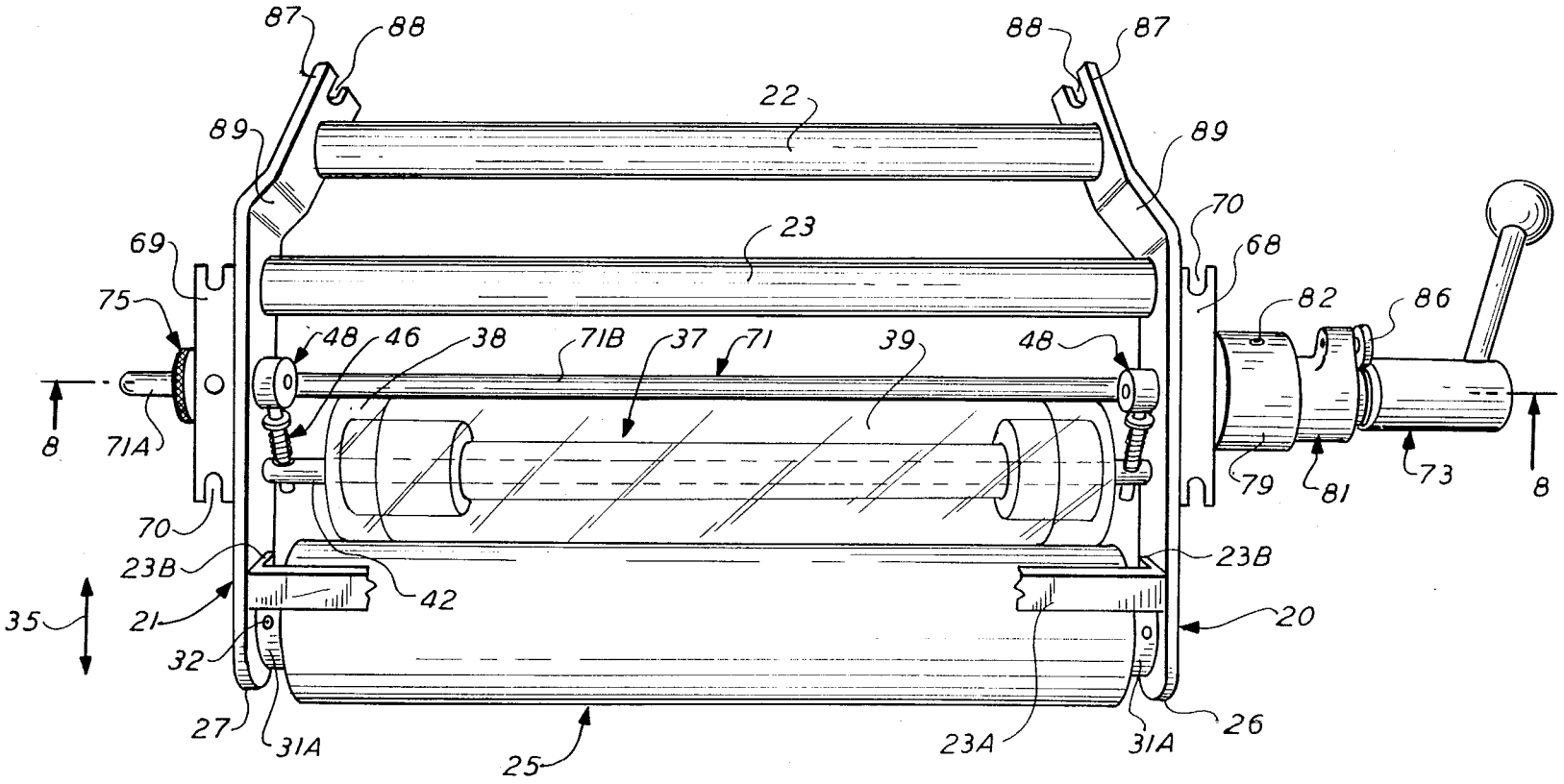
FIG. 3 is a bottom view of the auxiliary form roller apparatus of the invention with a portion of a support member broken away to reveal details of construction.

As seen in FIGS. 1, 2 and 3 of the drawings, the auxiliary form roller apparatus of the invention has a frame which is formed by a pair of oppositely-disposed, spaced-apart, substantially J-shaped support arms, indicated generally as 20 and 21, and three laterally-extending support members 22, 23 and 23A. The support arms 20 and 21 and the support member 23A may be fabricated of steel or aluminum, for example. The support members 22 and 23 are shaped as rods and may be made of Nylon, for example. As seen in FIG. 2, the ends of the support rods 22 and 23 may be secured to the support arms 20 and 21 by means of screws 24 so that a rigid, mechanically rugged frame is provided for the auxiliary form roller apparatus. The support member 23A has bent ends or flanges 23B which may be secured to the support arms by screws 23C so that the member projects a small distance beyond the edges of the support arms. This arrangement not only provides added lateral support for the ends of the arms which support the auxiliary form roller but also permits the apparatus of the invention to be set down on a table or the like for cleaning without the ink-covered auxiliary form roller touching the table top.

Figure 4:
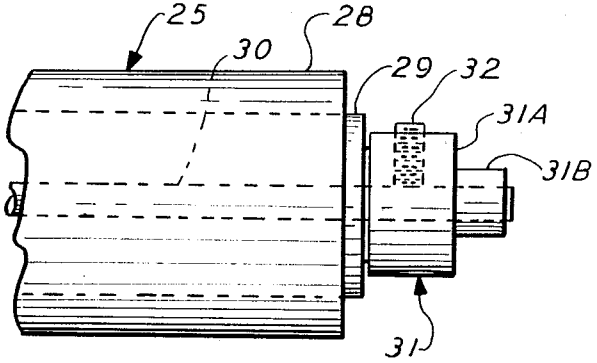
FIG. 4 is a fragmentary side elevational view showing one end of the auxiliary form roller of the apparatus of the invention.

The apparatus is provided with an auxiliary form roller, indicated generally as 25, which extends laterally between one end 26 of support arm 20 and one end 27 of support arm 21. As seen in FIGS. 2 and 4, the form roller 25 may have a hollow, cylindrical outer shell 28 of neoprene rubber or other suitable material which is concentrically mounted on an inner cylinder 29 of steel or other suitable bearing material. The ends of the cylinder 29 are mounted for rotation on a fixed shaft 30 so that the entire auxiliary form roller 25 is free to rotate about the shaft 30. The ends of the shaft 30 are seated in a bore extending through a pair of slidable end bearings, indicated generally as 31, and the shaft is prevented from rotating within the end bearings by means of set screws 32. Each of the end bearings 31 has a cylindrical spacer portion 31A and a square projecting bearing portion 31B which is slidably seated in a slot 33 formed adjacent each of the ends 26,27 of support arms 20, 21.

The square projecting bearing portions 31B of the end bearings prevent the bearings, and hence the shaft 30, from rotating with respect to the support arms 20,21 but permit the shaft and the auxiliary form roller 25 to move in the direction of the arrows 35 in FIG. 3. This movement is important because it gives the auxiliary form roller some "play" as it bears against the rotating master cylinder. This "play" is necessary because the ends of the image-bearing master sheet are secured in a depression or groove which extends laterally across the master cylinder. If the auxiliary form roller had no "play", it would bounce each time it encountered the groove during rotation of the master cylinder. The cylindrical spacer portions 31A of the end bearings may be made with different lateral lengths so that the auxiliary form roller 25 may be adjusted laterally with respect to the support arms 20, 21 to thereby compensate for minor variations in master cylinder location in many different types of duplicating machines in use at the present time.

Figure 5:
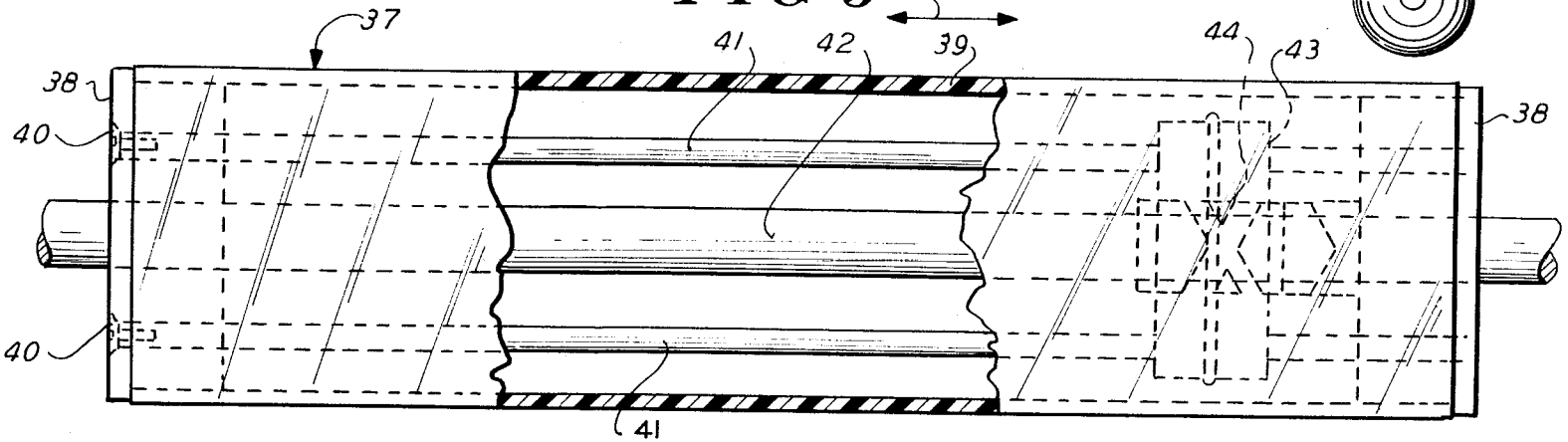
FIG. 5 is a top plan view of the auxiliary oscillator roller of the apparatus of the invention with a portion of the roller surface broken away to reveal details of construction.

The apparatus of the invention also includes an auxiliary oscillator roller, indicated generally as 37, which is disposed laterally between the support arms 20 and 21 of the frame. As seen in FIGS. 2, 3 and 5 of the drawings, the auxiliary oscillator roller 37 comprises a pair of cylindrical end caps 38 which are seated in the ends of a cylinder 39 which may be formed of a hard, clear plastic or other suitable ink handling material. The end caps 38 are secured by means, such as screws 40, for example, to the ends of a pair of support rods 41 which are disposed within the cylinder 39. The entire auxiliary oscillator roller 37 is rotatably mounted on a non-rotatable support shaft 42 which is substantially parallel to the shaft 30 of the auxiliary form roller 25. A follower member 43 is slidably disposed on the rods 41 in the interior of the cylinder 39 and is arranged to engage a double-threaded portion 44 on the oscillator roller support shaft 42, so that as the oscillator roller is rotated, it oscillates laterally in the direction of the arrows 45 shown in FIG. 5. Since this arrangement is well-known in the art, it will not be described further.

Figure 6:
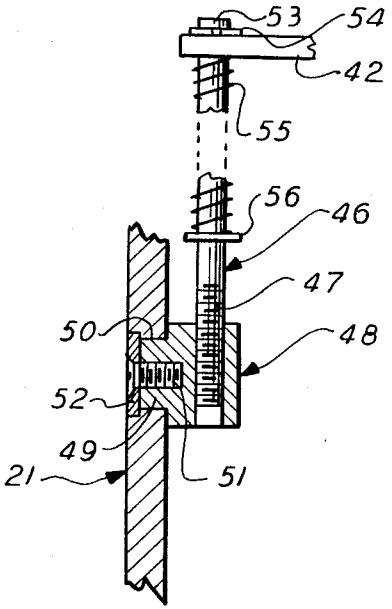
FIG. 6 is a full sectional view of one of the pivot bushings for the auxiliary oscillator roller of the apparatus of the invention with the oscillator roller support rod foreshortened for convenience of illustration.

As seen in FIGS. 2, 3 and 6 of the drawings, the shaft 42 of the auxiliary oscillator roller 37 is supported by a pair of adjusting screws, indicated generally as 46, which are disposed at opposite ends of the oscillator roller. Each of the adjusting screws 46 has an end 47 thereof which threadedly engages a cylindrical pivot bushing, indicated generally as 48. As seen in FIG. 6, the pivot bushing 48 is provided with an offset portion 49 of reduced diameter which is rotatably seated in a cylindrical bore 50 extending laterally through the support arm 20 or 21 associated therewith. The offset portion 49 of the pivot bushing may be held in place in the bore 50 by any suitable means, such as the recessed screw 51 and recessed bearing washer 51 illustrated, for example, so that the cylindrical pivot bushing is free to rotate about a laterally-extending axis which is substantially parallel to the shafts 30 and 42.

The other end 53 of each adjusting screw is not threaded and is slidably disposed in a transverse bore in the roller support shaft 42 adjacent the end thereof. The transverse bores adjacent the ends of the support shaft 42 are substantially perpendicular to the longitudinal axis of the support shaft so that the oscillator roller 37 may slide along the unthreaded portions 53 of the adjusting screws to vary the radial distance between the axis of rotation of the pivot bushings 48 and the longitudinal axis of the support shaft 42. The support shaft 42 may be prevented from sliding off the free ends 53 of the adjusting screws 46 by any convenient means, such as the annular detent and snap ring arrangement 54 illustrated in FIG. 6, for example. A helical compression spring 55 is concentrically disposed on each adjusting screw and is arranged to bear against the oscillator roller support shaft 42 and a collar 56 on the adjusting screw, so that the support shaft 42 is constantly forced against the free or outward end 53 of each of the adjusting screws. A slot (not shown) may be formed in the end 53 of each adjusting screw so that the screw may be rotated by a screw driver or the like within the pivot bushing 48 associated therewith to vary the radial distance between the longitudinal axis of the oscillator roller support shaft 42 and the axis of rotation of the bushing 48.

By virtue of this arrangement, the longitudinal axis of the auxiliary oscillator roller 37 may be rotated about a cylindrical path. The axis of rotation of the cylindrical path is the axis passing through the pivot bushings 48, so that the entire auxiliary oscillator roller 37 may be moved out of engagement with the auxiliary form roller 25. This permits the auxiliary oscillator roller to have its overall position adjusted with respect to the auxiliary form roller 25 and, as hereinafter explained, with respect to the existing form rollers on the duplicating machine to which the apparatus is attached. Furthermore, since each of the adjusting screws 46 may be independently adjusted to vary the radius of the circular path defined by each end of the shaft 42 when the auxiliary oscillator roller is rotated about the pivot bushings, the longitudinal axis of the oscillator roller may be adjusted or "tilted" to make it parallel to the longitudinal axes of the auxiliary form roller 25 and the machine form roller.

Figure 7:
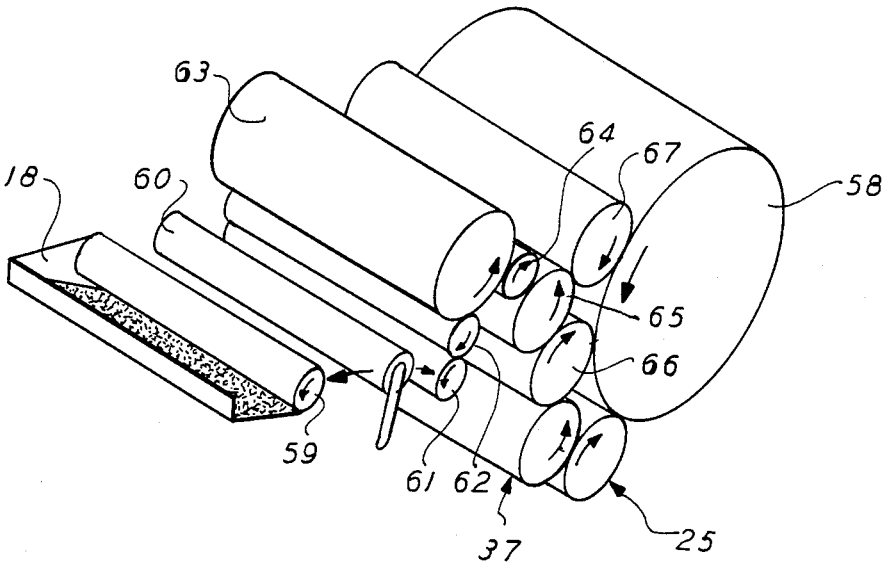
FIG. 7 is a schematic view of the ink roller train and master cylinder of a typical rotary offset lithographic duplicating machine with the auxiliary form roller apparatus of the invention in place showing the ink path from the ink fountain to the master cylinder.

FIG. 7 of the drawings shows the schematic relationship of the auxiliary form roller 25 and the auxiliary oscillator roller 37 of the apparatus of the invention to the master cylinder and the existing form rollers of a typical rotary offset lithographic duplicating machine. As seen in FIG. 7, the master cylinder 58 of the duplicating machine is normally supplied with ink from the ink fountain 18 by means of an ink roller train consisting of fountain roller 59, ductor roller 60, transfer rollers 61 and 62, machine oscillator roller 63, transfer roller 64, main oscillator roller 65 and the existing form rollers 66 and 67 of the duplicating machine. When the auxiliary form roller apparatus of the invention is installed on the machine as hereinafter described, the auxiliary form roller 25 contacts the periphery of the master cylinder 58 at a point which is a peripheral distance away from the contact points of the existing form rollers 66 and 67. The auxiliary oscillator roller 37 of the apparatus of the invention contacts both the existing form roller 66 of the machine and the auxiliary form roller 25 of the apparatus of the invention so that the auxiliary form roller 25 is supplied with ink from the ink on the existing form roller 66. Since the auxiliary form roller 25 is spaced a peripheral distance away from the two existing form rollers on the master cylinder, it is apparent that the ink supplied to the master cylinder will be more evenly distributed over the image areas during each revolution of the master. The adjusting screws 46 and the pivot bushings 48 of the auxiliary oscillator roller permit this roller to be adjusted to engage both the existing form roller 66 and the auxiliary form roller 25 and insure that the axis of the auxiliary oscillator roller 37 may be made parallel to the axes of the auxiliary form roller 25 and the existing form roller 66 to provide proper ink transfer.

Means for mounting the auxiliary apparatus of the invention on the main frame members 16A and 16B of the duplicating machine and control means for causing the auxiliary form roller 25 to engage and disengage the master cylinder 58 are shown in FIGS. 1, 2, 3 and 8–13 of the drawings. As seen therein, a pair of substantially rectangular mounting blocks 68 and 69 are disposed on opposite sides of the support arms 20, 21. Each mounting block is provided with grooves 70 at the ends thereof which are adapted to receive screws (not shown) which may be used to mount the blocks on the main frame members 16 of the machine. As hereinafter described, the screws threadably engage tapped holes in the main frame members 16A and 16B. An eccentric control shaft, indicated generally as 71, is disposed in elongated openings 72 formed in the support arms 20 and 21 of the frame. The eccentric control shaft 71 has a portion 71A at one end thereof which projects beyond support arm 21 on the gear side of the apparatus, a larger diameter portion 71B which extends between the support arms 20, 21 and is disposed in the slots 72, a still larger diameter portion 71C which projects beyond support arm 20 on the operator's side of the apparatus and a smaller diameter portion 71D at the other end thereof upon which a control handle, indicated generally as 73, is mounted and secured by a set screw 74. The portions 71A, 71C and 71D of the shaft are concentrically disposed about the axis of rotation of the shaft while the portion 71B of the shaft is eccentrically disposed with respect to that axis.

Figure 9:
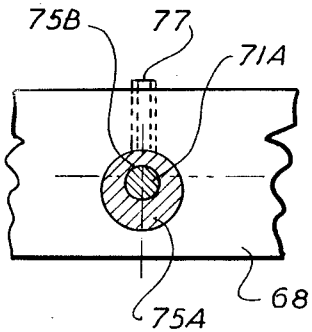
FIG. 9 is a full sectional view taken along the line 9—9 of FIG. 8 of the drawings showing the eccentric adjusting means and a portion of the mounting block on the gear side of the apparatus of the invention.

The portion 71A of the control shaft which is on the gear side of the machine is rotatably seated in a bushing, indicated generally as 75, which has a cylindrical projecting portion 75A which is rotatably disposed in a bore 76. A set screw 77 is provided to hold the bushing in place in the mounting block. As seen in FIG. 9, the bore 75B in which the control shaft portion 71A is seated is not concentric with the axis of rotation of the projecting portion 75A of the bushing, so that as the bushing is rotated it acts as an eccentric adjusting means which serves to adjust the position of the gear side of the apparatus of the invention, and hence the gear side of the auxiliary form roller 25, with respect to the machine and its master cylinder.

Figure 10:
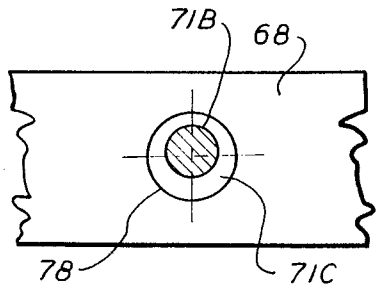
FIG. 10 is a full sectional view taken along the line 10—10 of FIG. 8 of the drawings showing a portion of the mounting block on the operator's side of the apparatus of the invention.
Figure 11:
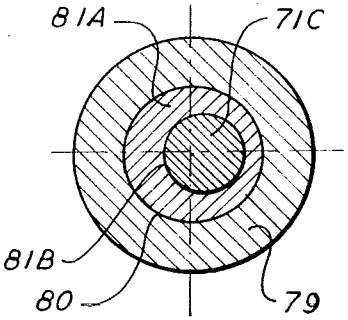
FIG. 11 is a full sectional view taken along the line 11—11 of FIG. 8 of the drawings showing the eccentric adjusting means on the operator's side of the apparatus of the invention.

As seen in FIG. 10, the mounting block 68 on the operator's side is provided with a lateral bore 78 which receives the control shaft portion 71C. The block also has a cylindrical boss 79 affixed to it by any suitable means. Since the boss is not movable with respect to the mounting block they may be formed as a single part if desired. The boss 79 has a lateral bore 80 in which is rotatably seated the cylindrical projecting portion 81A of a rotatable bushing, indicated generally as 81. As seen in FIG. 11, the portion 81A of the bushing has a bore 81B which receives control shaft portion 71C. The bore 81B is not concentrically located with respect to the cylindrical portion 81A of the bushing, however, so that as the bushing is rotated in the boss 79 it acts as an eccentric adjusting means to adjust the position of the operator's side of the apparatus of the invention, and hence the operator's side of the auxiliary form roller 25, with respect to the duplicating machine and its master cylinder. A set screw 82 is provided to lock the bushing 81 in place with respect to the boss 79.

As thus far described, it is apparent that the auxiliary form roller apparatus of the invention has means for independently adjusting both the gear side and the operator's side of the apparatus with respect to the duplicating machine and its master cylinder. It is also apparent that when the control shaft 71 is rotated by the control handle 73, both sides of the apparatus will be moved with respect to the duplicating machine and its master cylinder because the eccentric portion 71B of the control shaft is seated in the slots 72 of the support arms of the apparatus while the concentric portions 71A and 71C of the control shaft rotate in the mounting blocks which are affixed to the frame of the machine. Accordingly, as the control handle is rotated, the auxiliary form roller 25 is moved to either engage or disengage the master cylinder of the machine.

Figure 8:
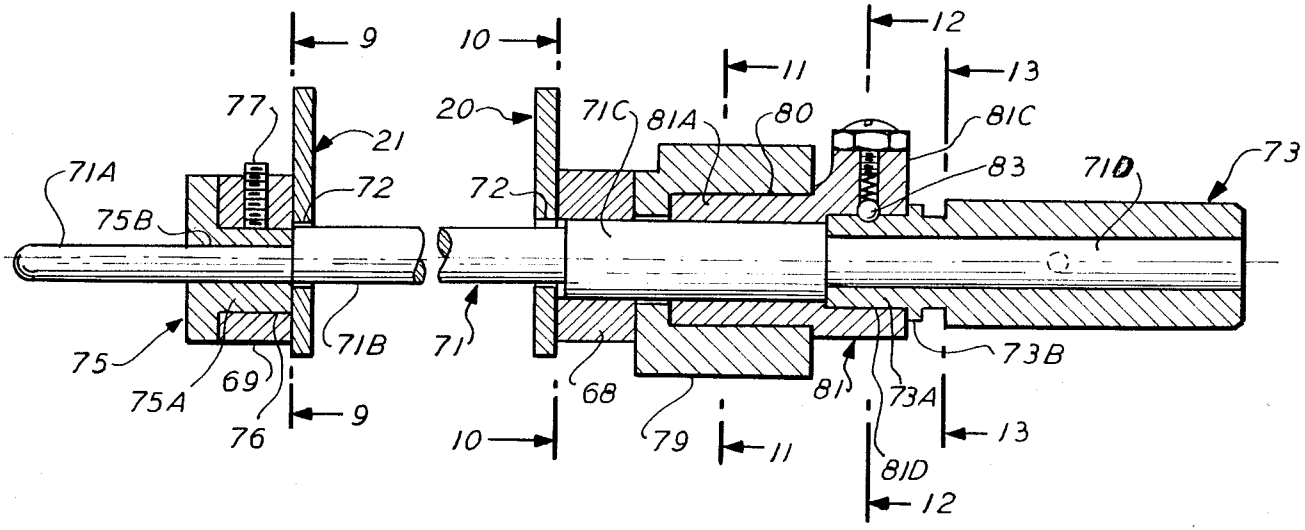
FIG. 8 is a full sectional view taken along the line 8—8 of FIG. 3 of the drawings showing the eccentric adjusting means for the auxiliary form roller of the apparatus of the invention with the eccentric shaft foreshortened for convenience of illustration.
Figure 13:
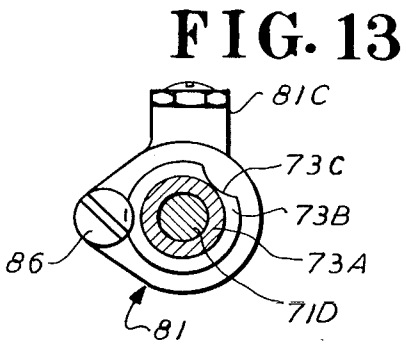
FIG. 13 is a full sectional view taken along the line 13—13 of FIG. 8 of the drawings showing the latching arrangement for the eccentric shaft handle.
Figure 12:
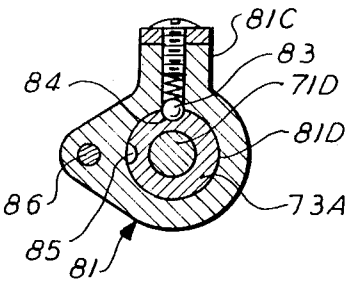
FIG. 12 is a full sectional view taken along the line 12—12 of FIG. 8 of the drawings showing the two-position detent arrangement of the eccentric shaft.

A detent arrangement providing an "engage position" and a "disengage position" for the control shaft is shown in FIGS. 8 and 12 of the drawings. As seen therein, the rotatable bushing 81 has a radially-projecting portion 81C which contains a spring-loaded ball 83 which is adapted to be seated in either of two detents 84 and 85 formed in a cylindrical portion 73A of control handle 73. The handle portion 73A is rotatably seated in a counterbore 81D in bushing 81. The detents 84 and 85 represent the engage and disengage positions of the auxiliary form roller 25, so that the operator of the machine may tell by "feel" when the auxiliary form roller engages the master cylinder. This arrangement permits ready access to the master cylinder of the machine so that the master sheet may be changed without removing the apparatus of the invention. The handle is also provided with a latching arrangement which prevents lateral movement of the handle but permits it to be rotated with respect to the bushing. As seen in FIGS. 8 and 13, the latching arrangement comprises a collar 73B on the handle and a retaining screw 86 on the bushing 81. The head of the retaining screw 86 overlies the collar 73B and prevents lateral movement of the handle 73 but permits rotational movement. An arcuate-shaped cutout 73C is provided in the collar 73B to permit the handle collar 73B to pass the screw 86 when the apparatus is being assembled or disassembled.

As thus far described, it is apparent that the auxiliary form roller apparatus of the invention is secured to the main frame members 16A and 16B of the machine by the mounting blocks 68 and 69 and the screws (not shown) associated therewith. As seen in FIGS. 1, 2 and 3 of the drawings, the other end 87 of each of the support arms 20, 21 is bifurcated to form a U-shaped notch or groove 88 which receives the main frame support rod 19 of the duplicating machine therein. This arrangement provides stability, so that when the axuiliary form roller apparatus of the invention is mounted on the main frame members 16 of the duplicating machine, there will be no tolerence or "play". It may be noted that the other ends 87 of the support arms 20, 21 are inwardly offset at 89 to provide a shorter lateral distance between the bifurcated ends 87, so that the apparatus may be mounted on the many different types of duplicating machines in use today and so that the control handle 73 will extend beyond the main frame members 16A of the machines for the convenience of the operator.

The previously described mounting arrangement for the auxiliary form roller apparatus of the invention permits it to be easily installed on virtually all of the rotary offset duplicating machines in service at the present time without requiring any significant structural modification of the existing machines. For example, in the Series 1200 models of the Multilith brand of duplicating machines, the four screws (which may be Allen screws) which are used to secure the mounting blocks 68 and 69 of the apparatus to the machine frame may be readily inserted into the four tapped holes which are found in the underside of the main frame members 16A and 16B and which are normally used to secure the master ejection tray to the duplicating machine. Since the use of the master ejection tray is not absolutely necessary for the operation of the machine, the auxiliary form roller apparatus of the invention may be easily installed by placing the bifurcated ends 87 of the support arms 20, 21 of the apparatus on the main frame support rod 19 and then securing the mounting blocks 68, 69 to the tapped holes in the main frame members 16. Because most of the other brands of duplicating machines in use at the present time have a main frame support rod which is located in approximately the same position as the rod 19 on the Multilith brand of machine, the apparatus of the invention may be easily installed on such other brands.

Figure 14:
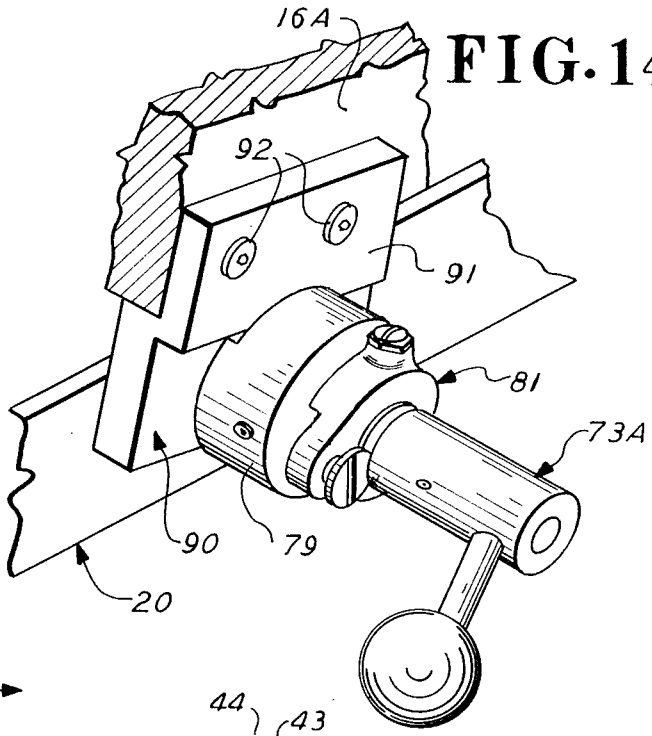
FIG. 14 is a fragmentary perspective view of an alternative form of mounting block which may be used to attach the auxiliary form roller apparatus of the invention to rotary offset lithographic duplicating machines.

When the apparatus of the invention is to be installed on some of the older models of rotary offset duplicating machines wherein tapped holes are not available or are impractical to install on the underside of the main frame support members 16, the alternative mounting block arrangement shown in FIG. 14 of the drawings may be utilized. As seen therein, the substantially rectangular, operator side mounting block 68 has been replaced by a mounting block, indicated generally as 90, which has an offset portion 91 which is secured to the side of the main frame support member 16A by a pair of screws 92. A similar mounting block (not shown) would be used for the gear side of the machine. When this arrangement is used, a template may be supplied with the apparatus to locate the holes on the sides of the main frame members 16 so that they may be easily drilled and tapped to receive the mounting screws 92. Since this is an easily accomplished procedure which is within the capability of most owners of existing duplicating machines, it is apparent that the apparatus of the invention may be easily installed even on those older models which do not have existing tapped holes on the underside of the main frame members 16.

It is believed apparent that many changes could be made in the construction and described uses of the foregoing auxiliary form roller apparatus and many seemingly different embodiments of the invention could be constructed without departing from the scope thereof. Accordingly, it is intended that all matter contained in the above description or shown in the accompanying drawings shall be interpreted as illustrative and not in a limiting sense.

What is claimed is:

1. Auxiliary form roller apparatus for attachment to rotary offset lithographic duplicating machines of the type having a bed, a pair of spaced-apart main frame members extending upwardly and outwardly from the bed, a main frame support rod extending laterally between the frame members adjacent the tops thereof, a master cylinder and at least one machine form roller contacting the master cylinder at a first point on the periphery thereof, said apparatus comprising an auxiliary form roller;

an auxiliary oscillator roller, said auxiliary oscillator roller being oscillatable laterally along its axis of rotation in response to rotation thereof;

an auxiliary frame having guide means at one end thereof adapted to pivotally engage the main frame support rod for support thereof, first mounting means at the other end thereof for rotatably mounting said auxiliary form roller thereon, and second mounting means disposed between the ends thereof for rotatably mounting said auxiliary oscillator roller thereon with the auxiliary oscillator roller in rolling contact with said auxiliary form roller; and third mounting means disposed between the ends of said auxiliary frame for mounting said auxiliary frame on the main frame members with said guide means engaging the main frame support rod, said auxiliary form roller contacting the master cylinder at a second point on the periphery thereof which is spaced a peripheral distance from the first point and said auxiliary oscillator roller engaging the machine form roller, so that ink from the machine form roller is transferred to the master cylinder via said auxiliary oscillator roller and said auxiliary form roller, said auxiliary frame comprising a pair of arcuately-shaped spaced-apart support arms having an arcuate length substantially corresponding to the arcuate distance between the main frame support rod and said second point on the periphery of the master cylinder, and support means extending laterally between said support arms for support thereof;

said guide means comprises a substantially U-shaped groove in one end of each of said support arms, said U-shaped groove pivotally engaging the main frame support rod; and said first mounting means is disposed at the other end of each of said support arms;

said apparatus further comprising control means disposed between said auxiliary frame and said third mounting means for causing relative movement therebetween, such that said support arms pivot about the longitudinal axis of the main frame support rod to thereby cause said auxiliary form roller to engage and disengage the master cylinder.

2. Auxiliary form roller apparatus as claimed in claim 1 wherein said third mounting means comprises a pair of mounting members adapted to be mounted on the main frame members, each of said mounting members having a laterally-extending bore therein;

said auxiliary frame has a pair of laterally-aligned slots therein on opposite sides thereof; and said control means comprises a rotatable control shaft having concentric portions adjacent the ends thereof, said concentric portions being rotatably disposed in said mounting member bores, and an eccentric portion extending between said concentric portions, said eccentric portion being rotatably disposed in said auxiliary frame slots, and handle means for rotating said control shaft, so that the eccentric shaft portion bears against the auxiliary frame to cause relative movement between said auxiliary frame and said mounting members.

3. Auxiliary form roller apparatus as claimed in claim 2 each of said main frame members including an underside wherein each of said mounting members comprises a substantially rectangular mounting block having a screw-receiving groove formed in each end thereof for securing said block to the underside of the main frame member associated therewith.

4. Auxiliary form roller apparatus as claimed in claim 2 wherein each of said mounting members comprises a substantially rectangular mounting block having an outwardly offset portion which is adapted to engage the side of the main frame member associated therewith, said offset portion of the mounting block having at least one laterally-extending screw-receiving aperture formed therein for securing said block to the side of the main frame member associated therewith.

5. Auxiliary form roller apparatus as claimed in claim 2 said apparatus having a gear side and operator's side wherein a rotatable bushing is provided on said mounting member on the gear side of said apparatus, said bushing having a rotatable base portion, and a cylindrical boss potion projecting from said base portion, said boss portion being rotatably mounted in a laterally-extending aperture in said gear side mounting member, and said laterally-extending bore in said gear side mounting member in which the gear side concentric portion of said control shaft is disposed is an eccentrically-disposed bore in said bushing, so that rotation of the bushing base portion adjusts the location of the eccentric bore with respect to the gear side mounting member, to thereby permit adjustment of the position of the gear side of said auxiliary form roller with respect to the master cylinder.

6. Auxiliary form roller apparatus as claimed in claim 2 said apparatus having a gear side and operator's side wherein a rotatable bushing is provided on said mounting member on the operator's side of said apparatus, said bushing having a rotatable base portion, and a cylindrical boss portion projecting from said base portion, said boss portion being rotatably mounted in a laterally-extending aperture in said operator's side mounting member, and said laterally-extending bore in said operator's side mounting member in which the operator's side concentric portion of said control shaft is disposed is an eccentrically-disposed bore in said bushing, so that rotation of the bushing base portion adjusts the location of the eccentric bore with respect to the operator's side mounting member, to thereby permit adjustment of the position of the operator's side of said auxiliary form roller with respect to the master cylinder.

7. Auxiliary form roller apparatus as claimed in claim 6 wherein said handle means has a cylindrical projecting portion which is rotatably disposed in a laterally-extending opening in the base portion of said rotatable bushing, said handle means projecting portion having at least one ball-receiving detent formed on the periphery thereof, and said rotatable bushing base portion has a radially-disposed spring-loaded ball therein which is adapted to be seated in said detent upon rotation of said handle means to a predetermined position, thereby providing indication of the engagement or disengagement of the auxiliary form roller with the master cylinder.

8. Auxiliary form roller apparatus as claimed in claim 1 wherein said second mounting means comprises a pair of spaced-apart mounting arms, each of said mounting arms having one end thereof pivotally mounted on a different one of said support arms so that the other end of the mounting arm is rotatable about the pivot point of the mounting in a plane which is substantially perpendicular to the axis of rotation of said auxiliary oscillator roller, an auxiliary oscillator roller support shaft having said auxiliary oscillator roller rotatably mounted thereon, said oscillator roller support shaft having transverse bores formed therein adjacent the ends thereof to slidably receive said other ends of said mounting arms therein, spring means disposed on said mounting arms between the ends thereof for forcing said oscillator roller support shaft radially outwardly toward said other ends of the mounting arms, and retaining means on said other ends of said mounting arms for preventing said oscillator roller support shaft from sliding off said mounting arms, so that the axis of rotation of said auxiliary oscillator roller is adapted to rotate about an axis passing through the mounting pivot points of said mounting arms and the auxiliary oscillator roller is biased into engagement with said auxiliary form roller and the machine form roller.

9. Auxiliary form roller apparatus as claimed in claim 8 wherein each of said mounting arms threadedly engages the pivotal mounting at said one end of the mounting arm, so that rotation of the mounting arm about its longitudinal axis adjusts the length of the arm and thereby adjusts the position of the axis of rotation of said auxiliary oscillator roller.

10. Auxiliary form roller apparatus as claimed in claim 1 wherein each of said support arms has a slotted opening formed therein adjacent said other end thereof, and said first mounting means comprises an auxiliary form roller support shaft having said auxiliary form roller rotatably mounted thereon, and a pair of bearing members mounted on the ends of said form roller support shaft, each of said bearing members having a base portion disposed between the end of said auxiliary form roller and the support arm associated therewith, and a substantially rectangular boss portion projecting from said base portion, said boss portion being slidably disposed in said slotted opening in the support arm associated therewith, so that the bearing members and the ends of said form roller support shaft are movable towards and away from said other ends of the support arms to thereby permit limited movement between said auxiliary form roller and the master cylinder upon rotation thereof.

11. Auxiliary form roller apparatus as claimed in claim 10 wherein the lateral thickness of the base portion of one of said bearing members is different from the lateral thickness of the base portion of the other of said bearing members, so that the lateral position of said auxiliary form roller on said auxiliary form roller support shaft may be adjusted by employing bearing members having base portions of varying thickness.

12. Auxiliary form roller apparatus as claimed in claim 1 wherein each of said support arms is substantially J-shaped and has a relatively straight leg portion and a curved foot portion, said U-shaped groove is disposed in the free end of said foot portion, and said foot portion is inwardly laterally offset with respect to said leg portion, so that said one end of said auxiliary frame has a shorter lateral length than said other end of said frame to thereby facilitate the mounting of the apparatus on the machine.

13. Auxiliary form roller apparatus as claimed in claim 12 wherein said support means includes a laterally-extending support bar disposed between said support arms adjacent said auxiliary form roller, the longitudinal axis of said support bar being spaced a distance from the axis of rotation of said auxiliary form roller which is greater than the radius of the auxiliary form roller, so that the auxiliary form roller will not contact the surface upon which the apparatus rests when the apparatus is not attached to the machine.

* * * * *